US006151955A

United States Patent [19]

Ostrowski et al.

[11] Patent Number: 6,151,955

[45] Date of Patent: Nov. 28, 2000

[54] DEVICE AND METHOD FOR TESTING A VAPOR RECOVERY SYSTEM

[75] Inventors: Gary Michael Ostrowski; Richard Michael Smith, both of Salisbury, Md.

[73] Assignee: Dresser Equipment Group, Inc., Carrollton, Tex.

[21] Appl. No.: 09/368,992

[22] Filed: Aug. 5, 1999

Related U.S. Application Data

[60] Provisional application No. 60/095,728, Aug. 7, 1998.

[51] Int. Cl.[7] ..... B67D 5/38; B67D 5/371

[52] U.S. Cl. ..... 73/40; 73/40.5 R; 141/59; 141/83; 141/96; 222/23; 222/44; 222/171; 222/424

[58] Field of Search ..... 73/1.57, 1.58, 73/40, 40.5 R; 141/59, 83, 94, 96, 392; 222/23, 40, 44, 47, 171, 424

[56] References Cited

U.S. PATENT DOCUMENTS

| | | | |
|---|---|---|---|
| 5,316,057 | 5/1994 | Hasselmann | 73/40.5 R |
| 5,437,183 | 8/1995 | Janssen et al. | 141/83 X |
| 5,450,883 | 9/1995 | Payne et al. | 73/40.5 R |
| 5,507,325 | 4/1996 | Finlayson | 141/83 |
| 5,779,097 | 7/1998 | Olson et al. | 141/59 |
| 5,871,651 | 2/1999 | McSpadden | 222/36 |

*Primary Examiner*—Daniel S. Larkin
*Attorney, Agent, or Firm*—Haynes and Boone LLP

[57] ABSTRACT

A device and method for testing for the recovery of vapor in a system in which a fluid is dispensed into a tank through a nozzle, according to which a vacuum is created to induce the flow of the vapor into the nozzle. The vacuum is measured and a display is provided that indicates whether or not the vacuum attains a predetermined threshold value.

13 Claims, 3 Drawing Sheets

DEVICE AND METHOD FOR TESTING A VAPOR RECOVERY SYSTEM

CROSS-REFERENCE TO RELATED APPLICATION

This application relates to provisional application Ser. No. 60/095,728 filed Aug. 7, 1998.

BACKGROUND OF THE INVENTION

This invention relates to a gasoline dispensing and vapor recovery system and, more particularly, to a device and method for testing a vapor recovery system to determine whether or not it is operating properly.

Many gasoline dispensing, or service, stations are designed to recover vapor from vehicle tanks during dispensing of the gasoline to the tank. To this end, openings are provided through the spout of the gasoline dispensing nozzle to receive the vapor from the vehicle tank during the dispensing of the gasoline. The vapor is then passed from the nozzle, through a separate conduit system, and to the gasoline underground storage tank, usually under the action of a vacuum pump.

In these systems, it is imperative that the operator of the service station know whether or not the vapor recovery system is, in fact, operating properly. Although test devices are available for this purpose, they are expensive, complicated, and bulky.

Therefore, what is needed is a device and method for testing for the operability of a vapor recovery system at a gasoline dispensing station which is inexpensive, simple, and compact.

SUMMARY OF THE INVENTION

Therefore, according to the device and method of the present invention, a vapor recovery system can be tested to ascertain whether or not it is operating properly. To this end, a fluid is dispensed into a tank through a nozzle and a vacuum is created to induce the flow of the vapor into the nozzle. The vacuum is measured and a display is provided that indicates whether or not the vacuum attains a predetermined threshold value.

The device and method of the present invention enables an operator to easily and quickly ascertain whether or not a vapor recovery system is operating, yet the device is relatively inexpensive, simple, and compact.

DESCRIPTION OF THE PREFERRED EMBODIMENTS

Figure 1:
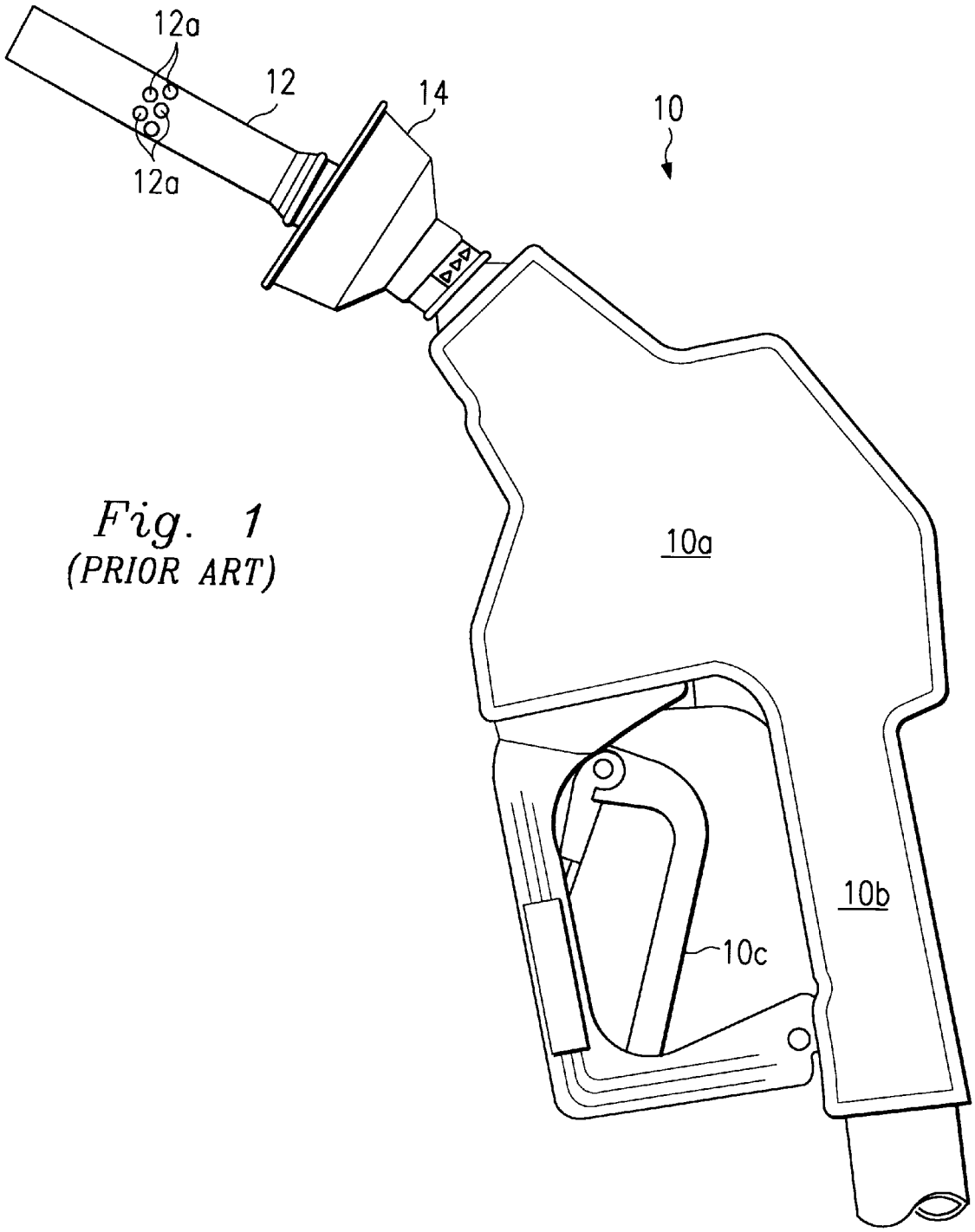
Fig. 1 (PRIOR ART)
FIG. 1 is a side elevational view depicting a typical gasoline dispensing and vapor recovery nozzle.

FIG. 1 depicts a prior art fluid dispensing nozzle 10, such as the type used with a gasoline dispenser in a service station for vehicles. The nozzle 10 includes a body member 10*a*, a handle 10*b* extending from the body member, and a trigger

10*c* pivotally mounted to the body member which, when pulled back towards the handle, opens a valve, or the like (not shown) in the body member. In a gasoline dispensing application, the nozzle 10 would be connected to a source of gasoline which would flow through appropriate passages in the handle 10*b* and the body member 10*a* so that the gasoline could be selectively dispensed from the nozzle by actuation of the trigger 10*c*.

A discharge spout 12 extends from the body member 10*a* for insertion into a vehicle tank (not shown) to dispense the gasoline, and a sealing device 14 is provided on the spout for engaging the mouth of the tank to seal the tank during the dispensing operation. A plurality of openings 12*a* are provided through the wall of the spout 12 for receiving vapor from the vehicle tank during the dispensing operation. The vapor is drawn from the vehicle tank, into the interior of the spout 12 through the openings 12*a* by a vacuum pump (not shown) located downstream from the nozzle 10 and operating at a predetermined RPM. It is understood that dual hoses (not shown) are provided in the body member 10*a*, the handle 10*b*, and the spout 12 for providing independent flow passages for the gasoline to be dispensed into the vehicle tank and for the recovered vapor to be returned to the storage tank, respectively. Since all of the above components are conventional, they will not be described in further detail.

Figure 2:
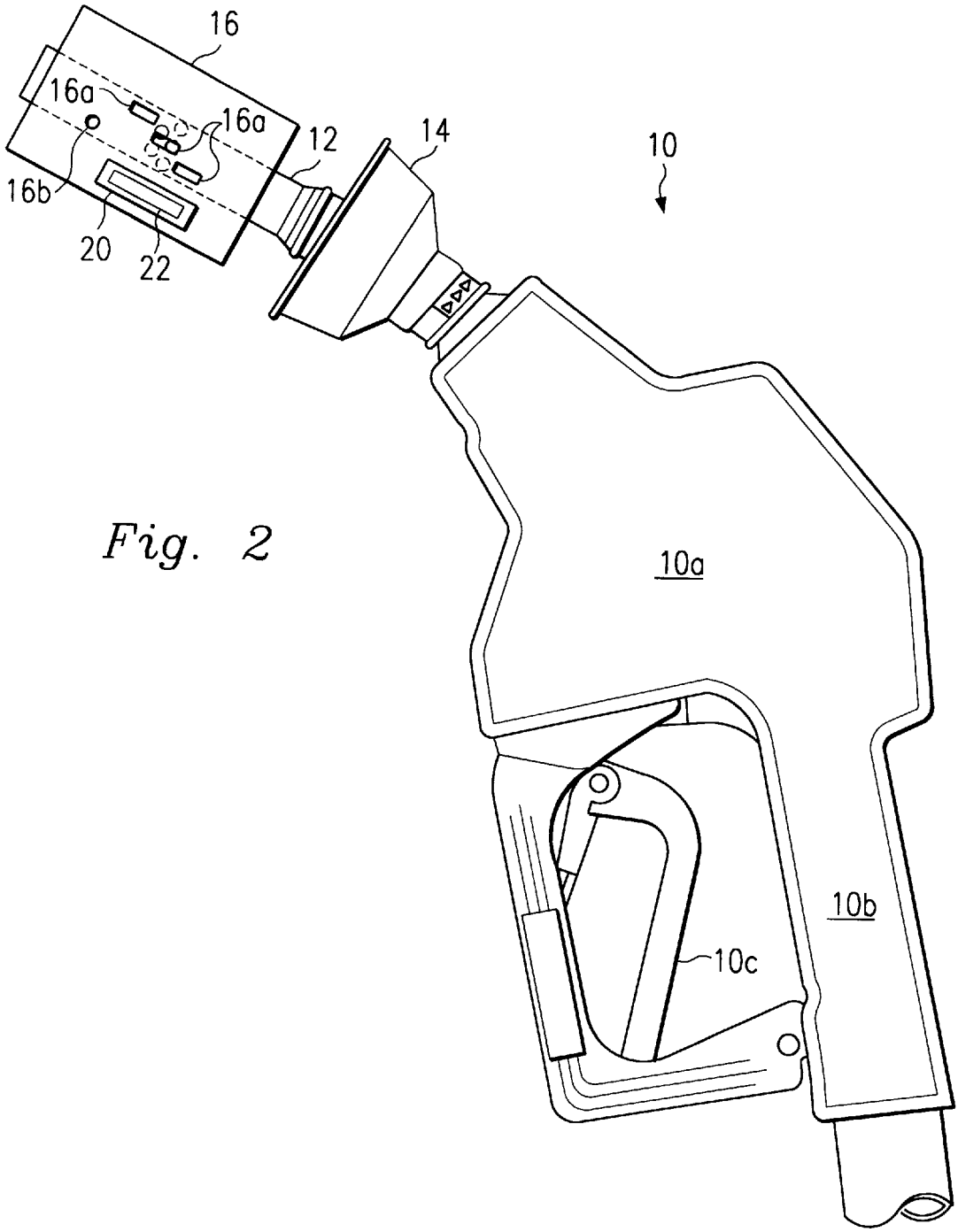
FIG. 2 is a view similar to FIG. 1, but depicting the nozzle with the test device of the present invention mounted on the spout of the nozzle.

A test device according to an embodiment of the present invention is shown by the reference numeral 16 in FIG. 2 mounted on the spout 12 of the nozzle 10. More particularly, the device 16 is in the form of a tubular member that fits over the outer surface of a portion of the spout 12 and is secured thereto in a fairly snug fit. The device 16 can be fabricated from plastic, aluminum, or any other suitable material.

Figure 3:
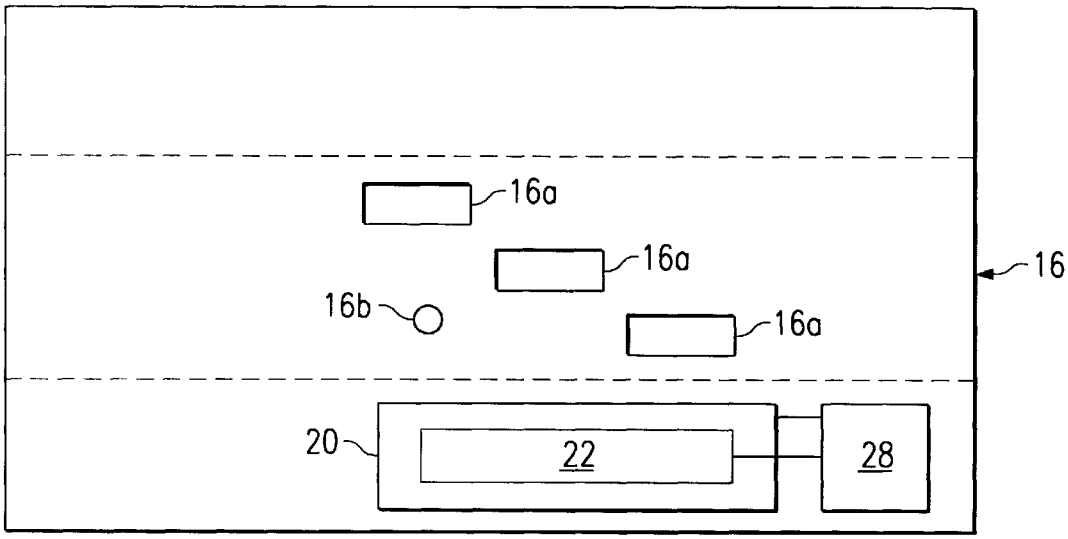
FIG. 3 is an enlarged elevational view of the test device of FIG. 2.

As better shown in FIG. 3, three angularly and axially spaced through slots 16*a* are provided through the wall of the device 16. At least a portion of the slots 16*a* register with at least a portion of the openings 12*a* in the spout 12, with the amount of registration depending on the axial and angular orientation of the device 16 relative to the spout. A sensing orifice 16*b* is also provided through the sleeve and registers with one of the openings 12*a* in the spout. The function of the orifice 16*b* will be described later.

A pressure sensor 20 is mounted on the device 16 for sensing the vacuum in the vapor recovery system and the flow rate of the gasoline from the spout. To this end, a tube, or the like (not shown) connects the sensing orifice 16*a* to an input of the sensor 20. Also, a pilot tube, or the like, (also not shown) is provided in the spout 12 and is located in a manner to measure the vacuum caused by the gasoline flowing through the spout and is connected to another input of the sensor 20. The sensor 20 responds to the above inputs and produces a corresponding output voltage that reflects the vacuum present in the vapor recovery system based on the particular flow rate of the dispensed gasoline. A conventional electrical circuit is provided that responds to the latter voltage and actuates a display 22 that is mounted adjacent to, or on the outer face of, the sensor 20. It is understood that the sensor 20 can be of a conventional design, such as a "26 PC Series Pressure Sensor" manufactured by Honeywell, Inc. of Freeport, Ill.

Figure 4:
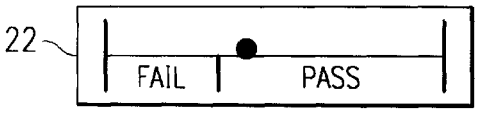
FIGS. 4–7 are enlarged views of four different displays that can be used with the test device of FIGS. 2 and 3.

The display 22 is depicted in detail in FIG. 4 and functions give an indication whether or not the vapor recover system is operating properly based on the output voltage from the sensor 20. More particularly, if the voltage output of the sensor 20 is above the acceptable threshold value, the display 22 will display "Pass", indicating that the vapor recover system is operating properly. If the voltage output of the sensor 20 is below the acceptable threshold value, the display 22 will display "Fail" indicating that the vapor recover system is not operating properly.

In operation, the spout 12 of the nozzle 10 is placed in the mouth of the gasoline tank of a vehicle, with the sealing device 14 providing a seal. The trigger 10*c* is pulled to dispense the gasoline through one of the hoses, or tubes, in the nozzle 10 and into the tank. A vacuum pump is actuated which establishes a vacuum that draws the gasoline vapors from the tank, through the openings 16*a* and the sensing orifice 16*b*, and through those portions of the openings 12*a* in the spout 12 that register with the openings 16*a* and the orifice 16*b*. The vapors then pass through a dedicated hose extending through the spout 12 and the nozzle 10 and to the gasoline storage tank. This vacuum sensed at the orifice 16*b* is inputted to the sensor 20 along with the flow rate of the gasoline being dispensed from the spout 12 in the manner described above, and the display 22 is actuated accordingly. Of course, if the display 22 indicates a "Pass" condition as discussed above, the operator is assured the system is to specification, while, if a "Fail" condition is indicated, corrective action can be taken.

Figure 5:
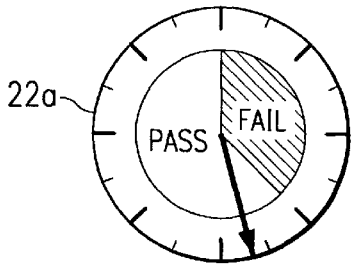
Figure 6:
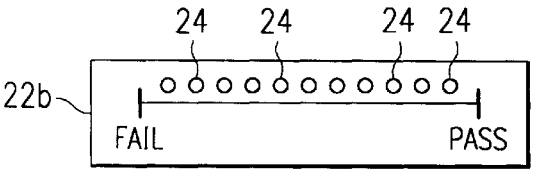
Figure 7:
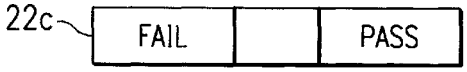

Alternate embodiments of the display 22 are shown in FIGS. 5–7. According to the embodiment of FIG. 5, a display 22*a* is provided which includes a hand that moves around a circle in a manner similar to that of a clock. Indications of "Pass" or "Fail" are provided on the circle to which the hand moves based on the voltage output of the sensor 20. The display 22*b* of the embodiment of FIG. 6 features a plurality of LEDs, or lights, 24 located in a row and adapted to respond to the voltage output of the sensor 20. In this arrangement, if relatively few, or no, lights are lit, a Fail condition exists, while if a relatively large number, or all, of the lights are lit, a Pass condition exists. FIG. 7 depicts an analog display 22*c* which provides a simple indication of Pass or Fail based on the actuation of lights behind the indicia in response to the voltage output of the sensor 20.

According to another alternate embodiment of the present invention, the sensor 20 is replaced by a basic vacuum sensor to sense the vacuum in the vapor recover system. A comparative circuit 28 (FIG. 3) is provided which compares the sensed vacuum to a predetermined threshold value based on the RPM of the vacuum pump and provides a corresponding output. The latter circuit is connected to one of the displays 22–22*c* to provide the above indications whether or not the vapor recover system is operating properly, in the manners described above.

Several advantages result from the foregoing. For example, the device and method of the above embodiments permit any operator to quickly ascertain whether or not a vapor recovery system is operating properly. Also, the device 16 is inexpensive and compact. Further, the flow of the vapor through the registered openings 16*a* and 12*a* can be adjusted by simply moving the device 16 angularly and/or axially relative to the spout 12. Also, since the device 16, and its associated display 22 and circuitry, is relatively easy to install, it can be left off of the spout 12 during normal operation of the gasoline dispensing and vapor recovery system and can be installed over the spout when the system is to be tested.

It is understood that variations may be made in the foregoing without departing from the scope of the present invention. For example, the test device and method of the present invention is not limited to the detection of gasoline vapor in a gasoline dispensing environment, but rather is equally applicable to other similar applications. Also, in a gasoline dispensing environment, the sensor 20 can be mounted on the nozzle 10 in a manner so that it does not extend in the vehicle tank, in which case it would measure the flow of ambient air that would be induced into the spout through the openings 16*a* and 12*a*. This flow measurement by the sensor 20 would be compared to a threshold value based on air flow rather than vapor flow, and the displays 22–22*c* would provide a corresponding indication. Further, the present invention is not limit to the specific displays disclosed above but is equally applicable to other displays.

It is understood that other modifications, changes, and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A system for recovering vapor from a vehicle tank, the system comprising:

a nozzle comprising:

a body member, and a spout extending from the body member, adapted to be inserted in the tank, and having at least one opening extending therethrough;

a tubular member for mounting on the spout and having at least one opening formed therethough for receiving the vapors;

the opening in the tubular member registering with the opening in the spout to permit the vapor to flow into the spout through the registered openings for recovery;

the flow of the vapor through the registered openings being adjustable by moving the tubular member angularly and/or axially relative to the spout;

a sensor mounted on the tubular member for sensing the vacuum and for providing a corresponding output; and a device for providing a display corresponding to the output of the sensor.

2. The system of claim 1 wherein the nozzle is connected to a source of gasoline for dispensing gasoline into the tank.

3. The system of claim 2 wherein the nozzle defines separate flow passages for the vapor and the gasoline.

4. The system of claim 1 where in there are a plurality of openings formed through the spout and through the tubular member.

5. The system of claim 4 wherein the number of openings in the tubular member that register with openings in the spout, and the degree of registration, vary with the movement of the tubular member relative to the spout.

6. The system of claim 1 further comprising a vacuum source connected to the body member for drawing the vapor through the registered openings in the tubular member and the spout.

7. The system of claim 6 further comprising a comparative circuit connected to the sensor and the display device for comparing the sensed vacuum to a predetermined threshold value based on the operation of the vacuum source and for providing a corresponding output to the display.

8. A test device for use in connection with vapor recovery from a tank into which a fluid is dispensed from a nozzle having a spout connected to a vacuum source and having at least one opening extending therethrough, the device comprising:

a tubular member for mounting on the spout and having at least one opening formed therethrough for receiving the vapors;

the opening in the tubular member registering with the opening in the nozzle to permit the vapor to flow into the spout through the registered openings for recovery;

the flow of the vapor through the registered openings being adjustable by moving the tubular member angularly and/or axially relative to the spout;

a sensor mounted on the tubular member for sensing the vacuum and for providing a corresponding output; and a device for providing a display corresponding to the output of the sensor.

9. The system of claim 8 wherein the nozzle is connected to a source of gasoline for dispensing gasoline into the tank.

10. The system of claim 9 wherein the nozzle defines separate flow passages for the vapor and the gasoline.

11. The device of claim 10 wherein the number of openings in the tubular member that register with openings in the spout, and the degree of registration, vary with the movement of the tubular member relative to the spout.

12. The system of claim 8 wherein there are a plurality of openings formed through the spout and through the tubular member.

13. The system of claim 8 further comprising a comparative circuit connected to the sensor and the display device for comparing the sensed vacuum to a predetermined threshold value based on the operation of the vacuum source and for providing a corresponding output to the display.

* * * * *